United States Patent [19]

Burgoon et al.

[11] 4,200,951

[45] May 6, 1980

[54] MACHINE FOR CLEANING SURFACES

[75] Inventors: Jack L. Burgoon, Toledo, Ohio; William R. Smith, Beaver Dam, N.Y.

[73] Assignee: The Scott & Fetzer Company, Lakewood, Ohio

[21] Appl. No.: 840,735

[22] Filed: Oct. 11, 1977

[51] Int. Cl.[2] ..... A47L 7/00

[52] U.S. Cl. ..... 15/321; 15/353; 15/410

[58] Field of Search ..... 15/320, 321, 353, 410, 15/416

[56] References Cited

U.S. PATENT DOCUMENTS

| | | | |
|---|---|---|---|
| 2,622,254 | 12/1952 | Mendelson | 15/320 X |
| 3,040,363 | 6/1962 | Krammes et al. | 15/320 |
| 3,206,787 | 9/1965 | Daniels et al. | 15/320 |
| 3,364,627 | 1/1968 | Wright | 15/320 X |
| 3,619,849 | 11/1971 | Jones | 15/321 |
| 3,742,546 | 7/1973 | Crener et al. | 15/320 X |
| 3,942,217 | 3/1976 | Bates | 15/321 |

FOREIGN PATENT DOCUMENTS

| | | | |
|---|---|---|---|
| 109854 | 4/1925 | Switzerland | 15/416 |

*Primary Examiner*—Christopher K. Moore
*Attorney, Agent, or Firm*—Allen D. Gutchess, Jr.

[57] ABSTRACT

A machine is provided for cleaning surfaces, including hard floors and carpeting. The machine has a frame with a disc brush rotatably carried thereby and driven by a motor which is mounted on a plate that is resiliently carried by the frame. A first vacuum nozzle and a squeegee are located at the back of the machine behind the disc brush for picking up cleaning solution when hard floors are being cleaned. The machine has a second nozzle located at the front thereof, in front of the disc brush, for picking up cleaning solution when carpeting is being cleaned and the machine is moved in a rearward direction. A cleaning solution supply tank is located on the frame and a recovery solution tank is located in the supply tank. A vacuum motor is mounted on a lid above the recovery tank and means are provided for connecting the recovery solution tank with each of the exhaust hoses for the two vacuum nozzles.

12 Claims, 12 Drawing Figures

134
132
112
82
74
120
76
78
72
32
34
40
30
84
24
28
26
70
36
38
86
42
44
88
46
146
136
98
140
142
144
138
54
68
48
52
50
58
60
66
62
64
56

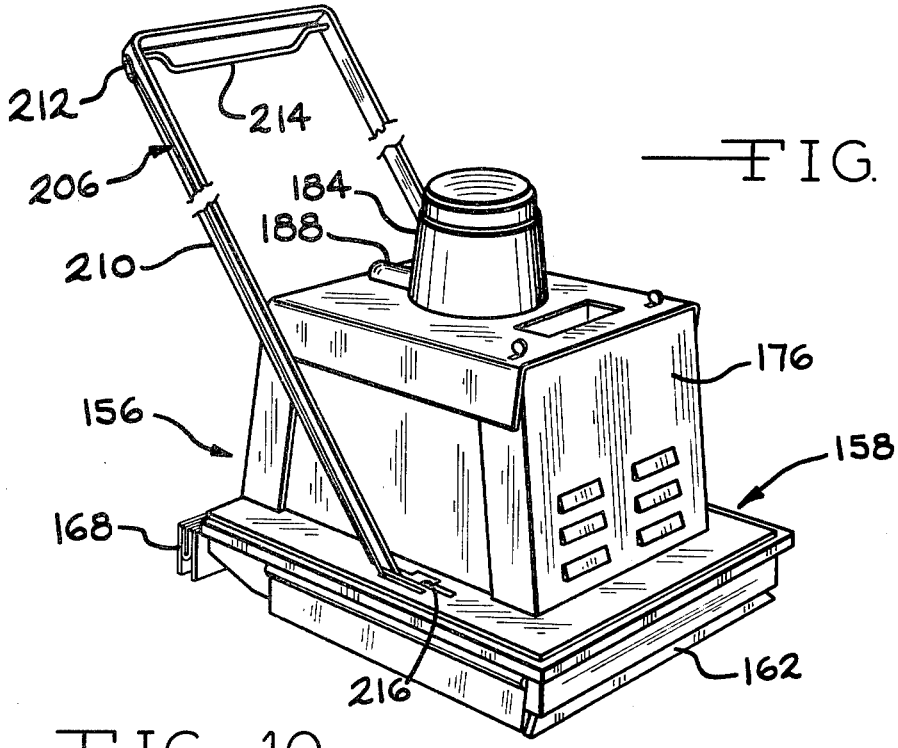
FIG. 9
FIG. 10
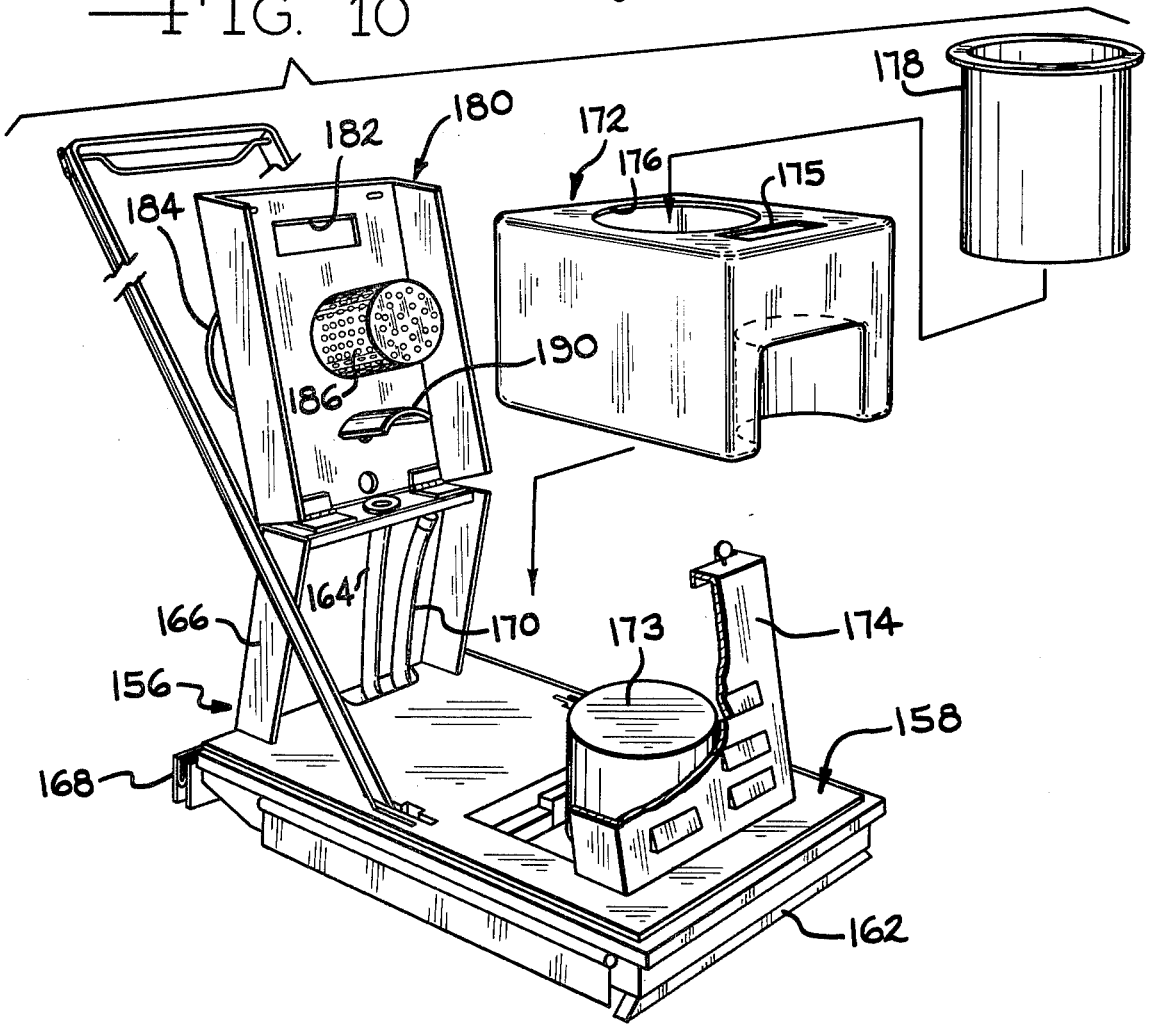

MACHINE FOR CLEANING SURFACES

This invention relates to a machine for cleaning surfaces, and particularly a variety of surfaces.

The machine includes a frame with a rotary disc brush mounted at an intermediate position therebelow. The disc brush is driven by a motor which preferably is not directly mounted on the frame but is supported on a mounting plate which, in turn, is resiliently carried by the frame so that the brush and motor can move independently of the frame. A squeegee and a first vacuum nozzle communicating with the squeegee are located at the rear of the frame behind the disc brush, particularly for picking up water and cleaning solution when the machine is used to scrub hard floors. The machine is also equipped with a second vacuum nozzle located at the front of the machine. This nozzle is employed to pick up cleaning solution when the machine is used to clean carpeting. In that instance, the machine is pulled rearwardly by the operator with the second nozzle picking up the recovery solution supplied through the disc brush to the carpeting. Hence, the machine can scrub and substantially dry the carpeting in one pass.

A cleaning solution supply tank or container is located on the supporting frame; in one instance, the supply tank can be removable from the frame. A recovery solution tank or container is located substantially wholly within the supply tank to provide a compact design. A vacuum motor is located on a lid above the recovery tank and a vacuum duct communicates with the recovery tank and can be connected to a hose for the rear exhaust nozzle or a hose for the front exhaust nozzle.

In one form of the invention, a handle used to manipulate the machine can be folded down across the tanks for storage and transportation. In another form, the handle can be pivotally connected relative to the frame and can be swung over the front of the machine to manipulate the rear squeegee near a wall or the like particularly when scrubbing hard floors, to pick up water close to the wall. The machine can also be provided with removable casters located near the front thereof to support some of the weight of the machine, particularly when hard floors are being scrubbed.

It is, therefore, a principal object of the invention to provide an improved floor cleaning machine having the features and advantages discussed above.

Many other objects and advantages of the invention will be apparent from the following detailed description of a preferred embodiment thereof, reference being made to the accompanying drawings, in which:

FIG. 9 is a somewhat schematic view in perspective of a modified surface cleaning machine according to the invention;

FIG. 10 is an exploded view in perspective of the machine of FIG. 9, with parts broken away and with parts in cross section;

Figure 1:
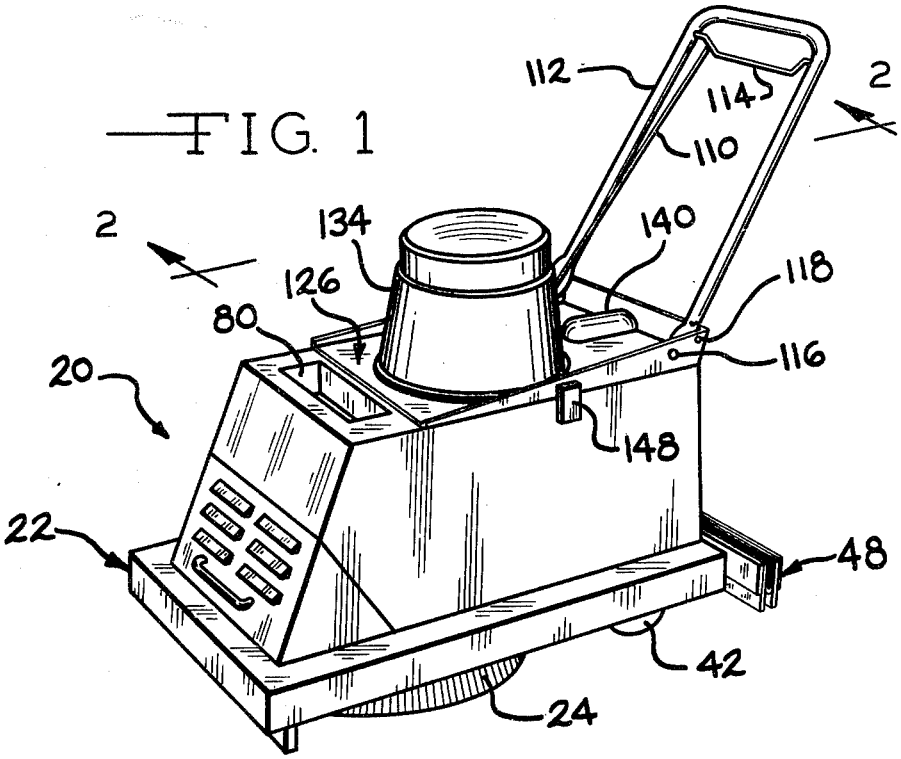
FIG. 1 is a somewhat schematic view in perspective of a surface cleaning machine embodying the invention.
Figure 3:
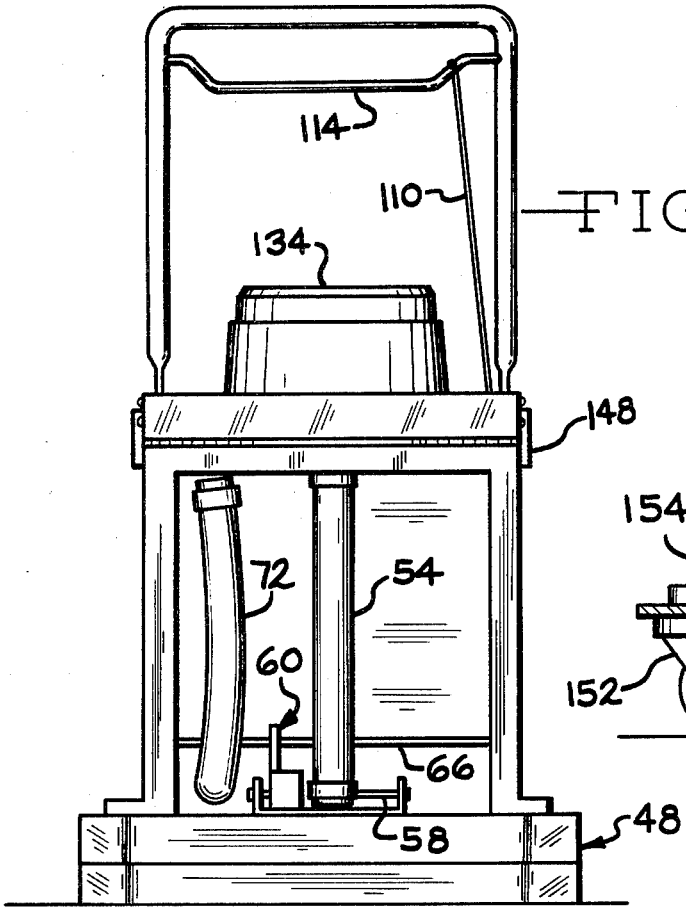
FIG. 3 is a somewhat schematic rear view in elevation of the floor cleaning machine.

Referring to the drawings, and more particularly to FIGS. 1-4, a surface cleaning machine embodying the invention is indicated at 20. The machine includes a main frame or body 22 below an intermediate portion of which is a rotatable disc brush 24. This brush is of a known construction and includes bristles 26 and a backing plate 28. The backing plate 28 is connected through a gear reduction housing 30 to an electric motor 32 which is mounted directly on a platform 34. This is supported through posts 36 and coil springs 38 from a frame member 40 which extends transversely across the main frame 22. A pair of main, rear wheels 42 are also located below the frame 22, to the rear of the disc brush 24 and are rotatably supported by the frame 22 through brackets 44 and an axle 46.

A squeegee assembly 48 is located to the rear of the disc brush 24 and to the rear of the wheels 42. The squeegee assembly 48 includes two spaced squeegee blades 50 (FIG. 2) forming an elongate vacuum nozzle 52 and a flexible exhaust hose 54 communicates with a middle portion of the nozzle 52. The squeegee assembly 48 is mounted on a pair of arms 56 which are pivoted about the axle 46. A rod 58 extends between intermediate portions of the arms 56. An adjustable ear 60 having notches 62 therein is rotatably mounted on the rod 58 and is urged in a counterclockwise direction by a torsion spring 64. The notches 62 can engage a rod 66 extending across the frame 22 and the notches 62 can be disengaged from the rod by a foot lever 68 extending rearwardly from the ear 60.

In the operating position, the squeegee assembly 48 is all the way down and the rod 66 is above the notches 62. In this position, a coiled spring (not shown) can be located around the exhaust hose 54 and placed in compression to place pressure of the squeegee assembly on the floor surface being cleaned, if desired. The squeegee assembly 48 on the machine 20 is designed specifically for scrubbing hard floors and, in that instance, cleaning solution is supplied to the disc brush 24 and the brush is rotated to clean the floor. As the machine is then moved forwardly, the squeegee assembly 48 picks up the dirty water, specifically by the vacuum nozzle 52 between the blades 50 which communicates with the hose 54.

With the rod 66 in the lower notch, the squeegee assembly 48 is raised to the highest position to facilitate transportation and storage of the machine. When the squeegee assembly 48 is only to be raised temporarily, during a double scrubbing operation, for example, then the rod can be placed in the upper notch 62 which is sufficient to keep the squeegee out of the way during the scrubbing operation.

A second vacuum nozzle 70 is located at the front of the machine, in front of the disc brush 24 and communicates with an exhaust hose 72 which extends rearwardly around one side of the gear reduction housing 30 and up the back of the machine adjacent the exhaust hose 54. When the exhaust hose 72 is hooked to a vacuum source, the machine 20 is effective for cleaning carpet. In that instance, cleaning solution is supplied to the carpet through the disc brush 24 and is picked up by the front vacuum nozzle 70 so that in one rearward pass, the carpeting can be scrubbed and substantially dried since more than eighty percent of the cleaning solution will be picked up by the front nozzle 70. When used to clean carpet, the squeegee assembly is raised. However, the front vacuum nozzle 70 need not be raised when the machine is used to clean a hard floor, although for extensive cleaning, the nozzle can be removed.

Figure 2:
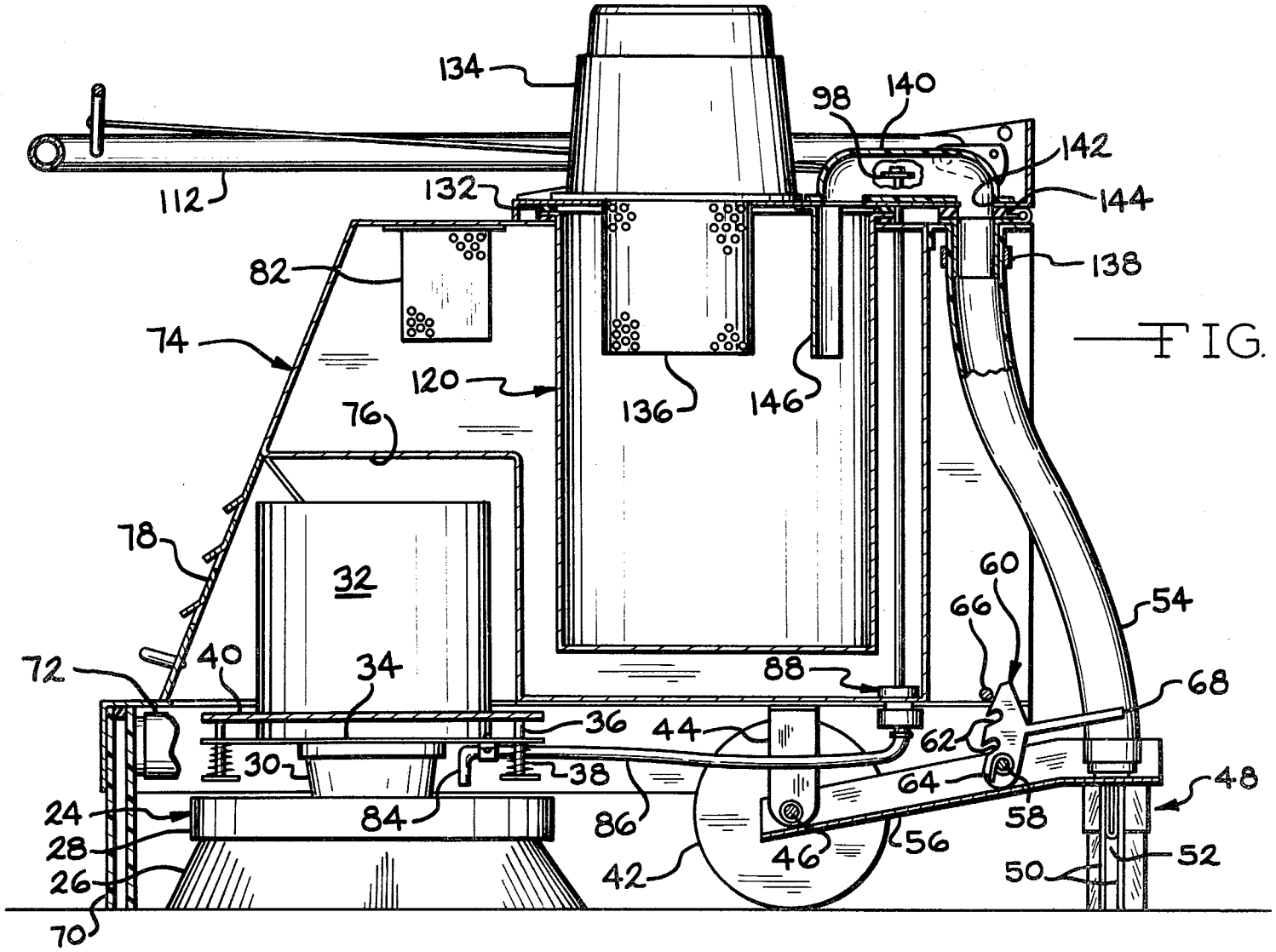
FIG. 2 is a view in longitudinal cross section of the machine of FIG. 1, taken generally along the line 2—2 of FIG. 1.

A cleaning solution supply tank 74 is, in this instance, permanently mounted on the frame 22. The supply tank 74 is formed with a front recess 76 entering around a rear portion of the motor 32 and a separate, removable grid 78 extends around a front portion of the motor. The cleaning solution tank also has an upper fill opening 80 (FIG. 1) below which extends a splash screen 82 (FIG. 2).

Figure 5:
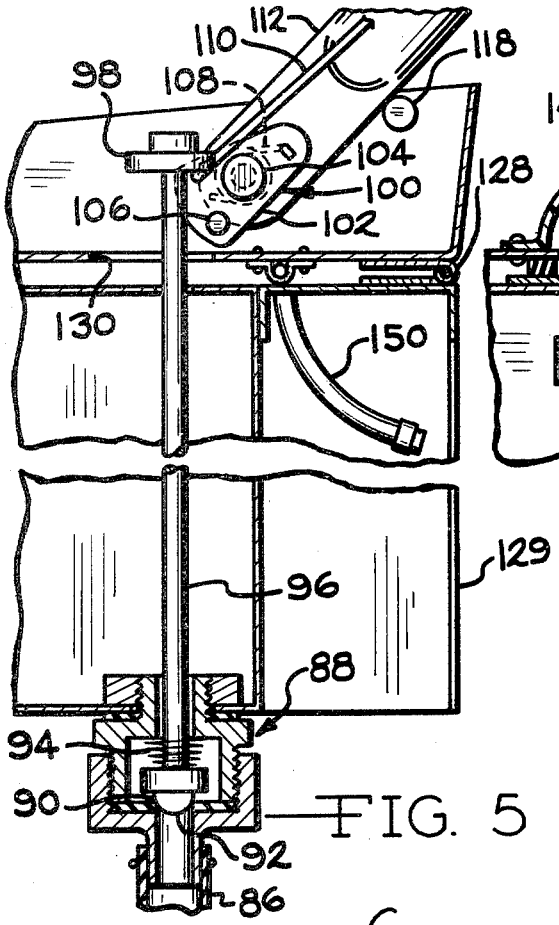
FIG. 5 is an enlarged, fragmentary view taken generally in vertical cross section and showing a flow control valve for cleaning solution.

Cleaning solution is supplied from the tank 74 to the brush 24 through a nozzle 84 which is mounted on the lower surface of the plate 34. A flexible supply line 86 communicates with the nozzle 84 and with a valve indicated at 88 mounted in the bottom of the tank 74. As shown in FIG. 5, the valve 88 includes a flexible valve seat 90 and a semi-spherical valve body 92 urged against the valve seat by a coil spring 94. A valve-operating rod 96 extends upwardly from the valve body 92 through the supply tank 74 and out the top where it is equipped with an enlarged head or flange 98.

A lift mechanism indicated at 100 is used to raise the valve-operating rod 96. The mechanism 100 includes a generally triangular plate 102 rotatably mounted on an axle 104 and having a transverse lifting pin 106. The plate 102 is urged in a counterclockwise direction, as viewed in FIG. 5, by a torsion spring 108. Thus, the pin 106 is normally below the enlarged head and the valve 88 is closed. When the plate 102 is rotated in a clockwise direction, however, the pin 106 raises the head 98 (FIG. 7) and opens the valve by moving the valve body 92 away from the valve seat 90.

Figure 6:
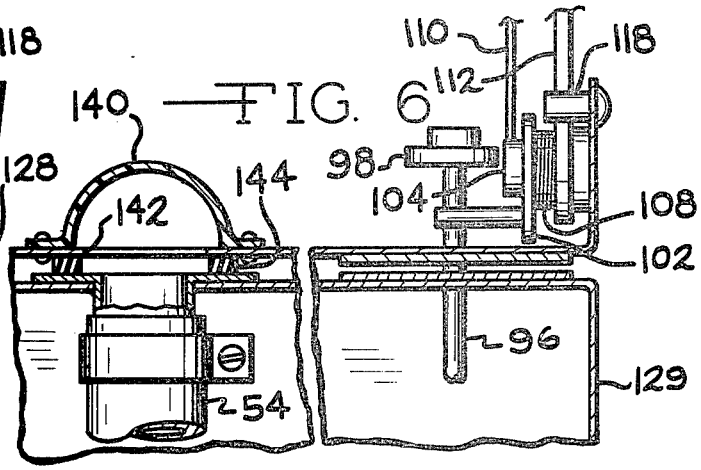
FIG. 6 is a view in transverse, vertical cross section of some of the valve components of FIG. 5 from the rear.
Figure 7:
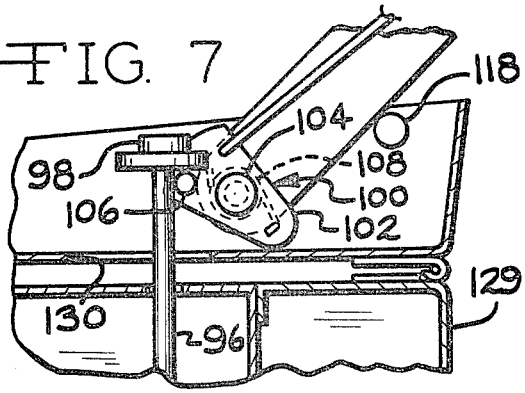
FIG. 7 is a detailed, fragmentary view of some of the valve components of FIG. 5 shown in a different position.

Movement of the plate 102 in the clockwise direction is accomplished by a connecting rod 110 which extends upwardly along one side of a handle 112 (FIG. 1) to a shallow U-shaped, manually-operated bar 114 pivotally connected to the handle near the upper portion thereof. This is manipulated by the operator to open and close the valve 88. The lower ends of the handle 112 are pivotally connected to the machine by the axle 104 adjacent the valve head 98 and by a pivot pin 116 (FIG. 1) on the opposite side of the machine. The handle 112 thereby can be pivoted down on the top of the machine, as shown in FIG. 2, to provide a compact arrangement for storage. At this time, the transverse pin 106 is swung back and away from the valve head 98 so as not to interfere therewith. In the operating position, the handle 110 rests against stops 118 (FIGS. 5–7).

Figure 4:
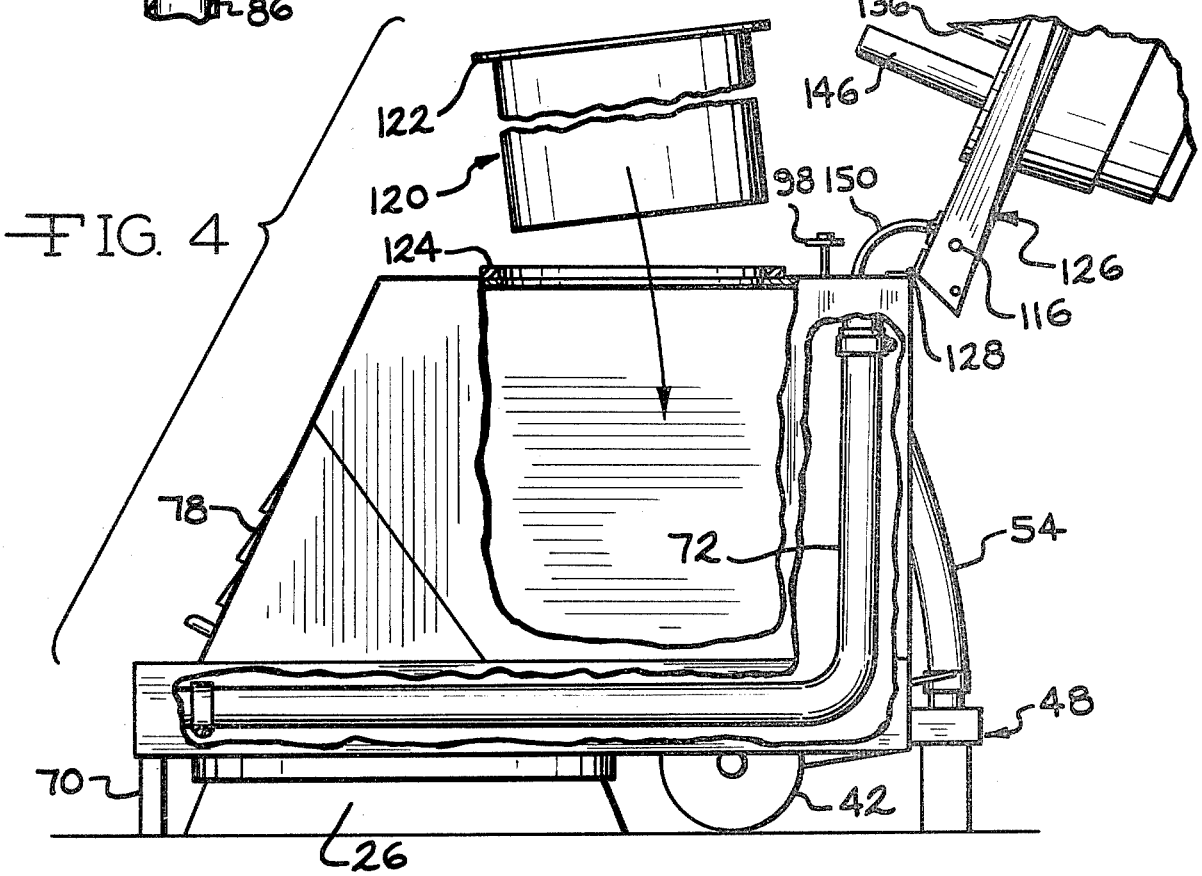
FIG. 4 is a fragmentary side view in elevation, with parts broken away and with parts in cross section, of the floor cleaning machine, with components shown in different positions.

A recovery tank 120 is used to receive the dirty solution picked up by either nozzle and is located substantially wholly within the supply tank 74. The tank 120 extends through an opening in the top of the recovery solution tank and has a flange 122 which seats on a resilient ring or gasket 124 (FIG. 4). This arrangement provides an exceptionally compact design for the machine which would not otherwise be obtained with separate tanks.

A lid 126 is pivotally attached by hinges 128 at the back to a vertical frame support 129, with the lid carrying the handle 112 and the valve-operating mechanism. The lid has an opening 130 (FIGS. 5 and 7) which clears the valve head 98 when the lid is raised. The lid also has a resilient ring or gasket 132 (FIG. 2) which seals against the top of the recovery tank flange 122 when the lid is closed. A vacuum blower 134 is mounted on the lid 126 and has an inlet screen 136 which extends into the recovery tank 120 when the lid is closed. When the blower is operating, a negative pressure is established in the tank 120, with the tank communicating with either of the hoses 54 and 72 through a nipple 138 and a shallow U-shaped connecting conduit 140 (see also FIG. 6) which is mounted on the lid and communicates with the nipple 138 through an opening 142 in the lid, with a gasket 144 located therebetween. The conduit 140 also communicates with the recovery tank, being separated from the vacuum blower inlet 136 by a baffle 146. This causes the air being drawn into the tank to move in a U-shaped path to further facilitate the extraction of the dirty cleaning solution from the air. The conduit 140 can be made of transparent plastic material to enable the operator to view the solution picked up by the machine.

The lid 126 is held down by two over-center side latches 148 (FIG. 1) which hold the various component in tight sealing relationship when the lid is closed. The lid also has two arcuate guide rods 150 (FIG. 4) which limit the extent to which the lid is opened and hold the lid in the opened position.

Figure 8:
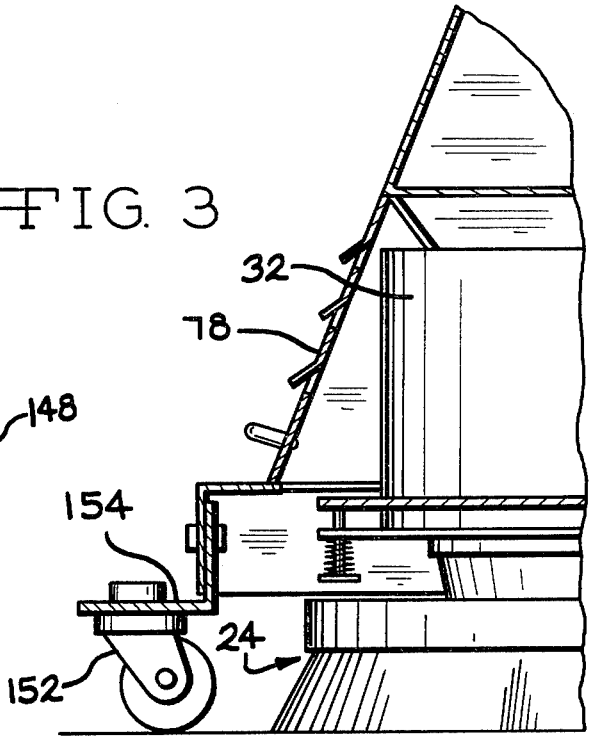
FIG. 8 is a fragmentary view in longitudinal vertical cross section showing a slightly modified surface cleaning machine.

Referring to FIG. 8, the front nozzle 70 can be replaced by two casters 152 mounted on an L-shaped flange 154 which can be removably bolted to the front member of the frame 22. The casters 152 support the front portion of the machine to facilitate a scrubbing operation for hard floors. Also, if desired, the brush 24 can be removed and the rear squeegee 48 then used only for a pick up operation, to remove water left by other scrubbing equipment.

A modified surface cleaning machine 156 is shown in FIGS. 9–12. The machine 156 differs from the machine 20 in several respects. In this instance, a cleaning solution supply tank is separate from the main frame of the machine, along with the recovery tank. The handle is mounted in a manner such that it can be pivoted forwardly to manipulate a rear squeegee of the machine near a wall or other obstruction. A cleaning solution supply system is different from that of the machine 20, and the handle is arranged to automatically raise the squeegee for transportation purposes.

The machine 156 has a main frame 158 with a disc brush 160 (FIG. 11) mounted therebelow in a position similar to that of the brush 24 for the machine 20. The machine has a front nozzle 162 with a vacuum hose 164 (FIG. 10) extending inside a rear hood or frame support 166. The machine also has a rear squeegee and nozzle 168 communicating with a vacuum hose 170 also extending within the hood 166.

A removable cleaning solution supply tank 172 is located on the frame 158 and is shaped to partially surround a motor 173 for the brush. The motor is also partly enclosed by a forward hood or frame support 174. The tank is made of in one piece of plastic material and has a filler opening 175 and a rear opening 176 formed in the top. A recovery tank 178 is also located within the supply tank 172, through the opening 176, in a manner similar to that shown for the machine 20. A lid 180, in this instance, is hinged to the rear hood 166 and has a forward fill opening 182 therein with a vacuum blower 184 mounted thereon, having an inlet screen 186 which extends into the recovery tank 178. A vacuum conduit 188 communicates with either of the hoses 164 and 170 and the recovery tank 178, with a baffle 190 separating the conduit 188 and the vacuum inlet 186.

Figure 11:
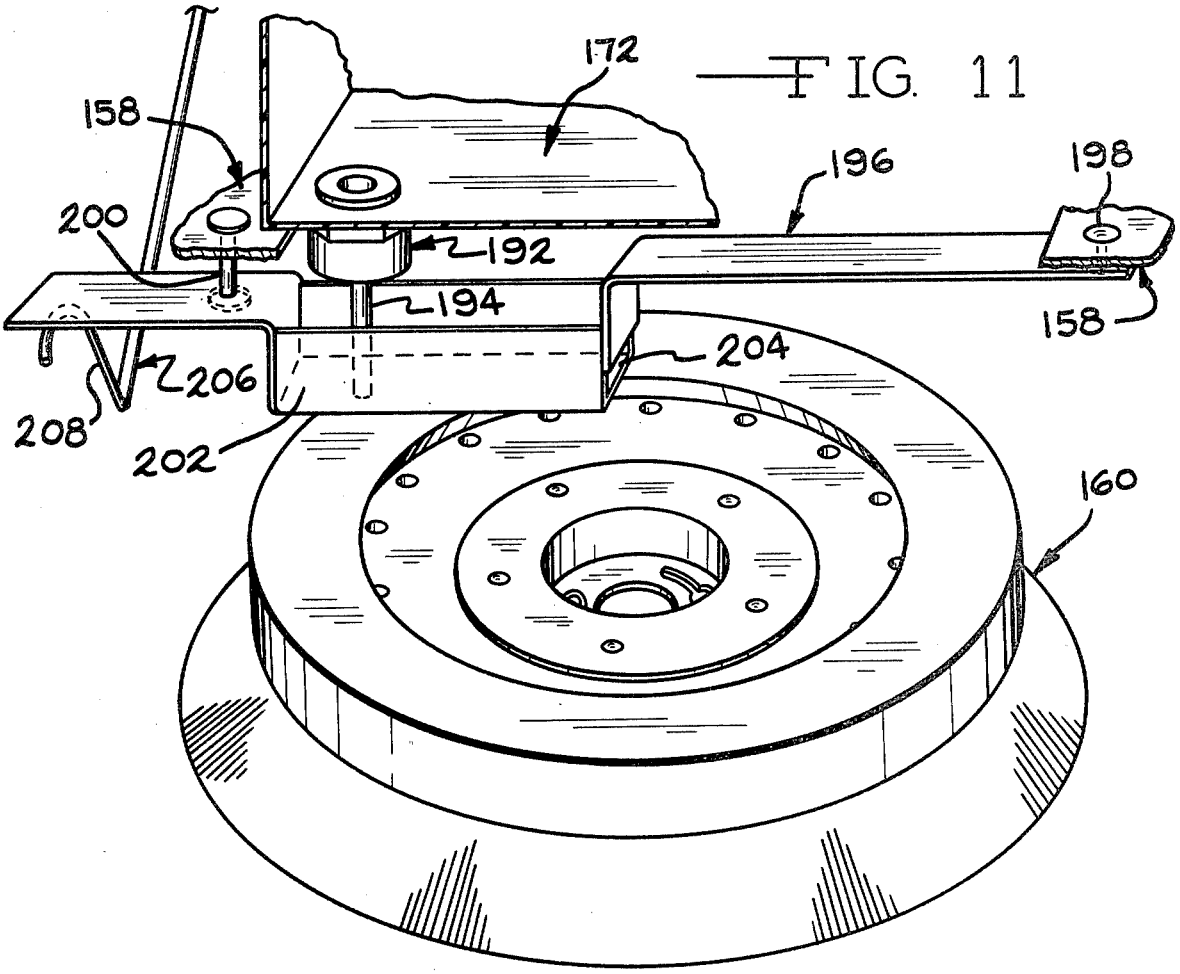
FIG. 11 is an enlarged, fragmentary view in perspective of a portion of the cleaning solution supply system for the machine of FIG. 9.

For supplying the cleaning solution to the brush 160, the arrangement shown in FIG. 11 is employed. A valve 192 is mounted in the bottom of the cleaning solution supply tank 172. The valve has a stem 194 extending downwardly when in position on the frame 158, with the valve opening when the stem 194 is pushed upwardly to urge a valve body (not shown) away from a valve seat. An elongate member 196 is located above the brush 160 and extends under the valve stem 194. The elongate member 196 is pivoted at 198 to a portion of the frame 158 and has a guide and stop rod 200 located at the other end. The member also forms an elongate trough 202 having an opening 204 at one end thereof spaced from the valve stem 194. When the elongate member 196 is raised, the valve opens and the water flows from the valve out the trough opening 204 to the top of the brush from which it is distributed through openings in the brush to the bristles in a known manner.

To raise the elongate member 196, an L-shaped operating rod 206 with an L-shaped end 208 is located adjacent a handle 210 (FIG. 9) and extends up to a link 212 which is turned by an operating bar 214. When the bar is pivoted, the rod 206 is raised to raise the member 196 through the end 208 and thereby supply water to the brush. When the handle 210 is pivoted to the opposite side of the machine, the L-shaped end 208 of the operating rod 206 swings clear of the elongate member 196.

The handle 210 extends through slots 216 in the frame 158 with the ends of the slots providing end stops for the pivotal movement of the handle 210. With the handle in the opposite direction, the squeegee 168 can be placed adjacent a wall or a baseboard to pick up water very close thereto.

Figure 12:
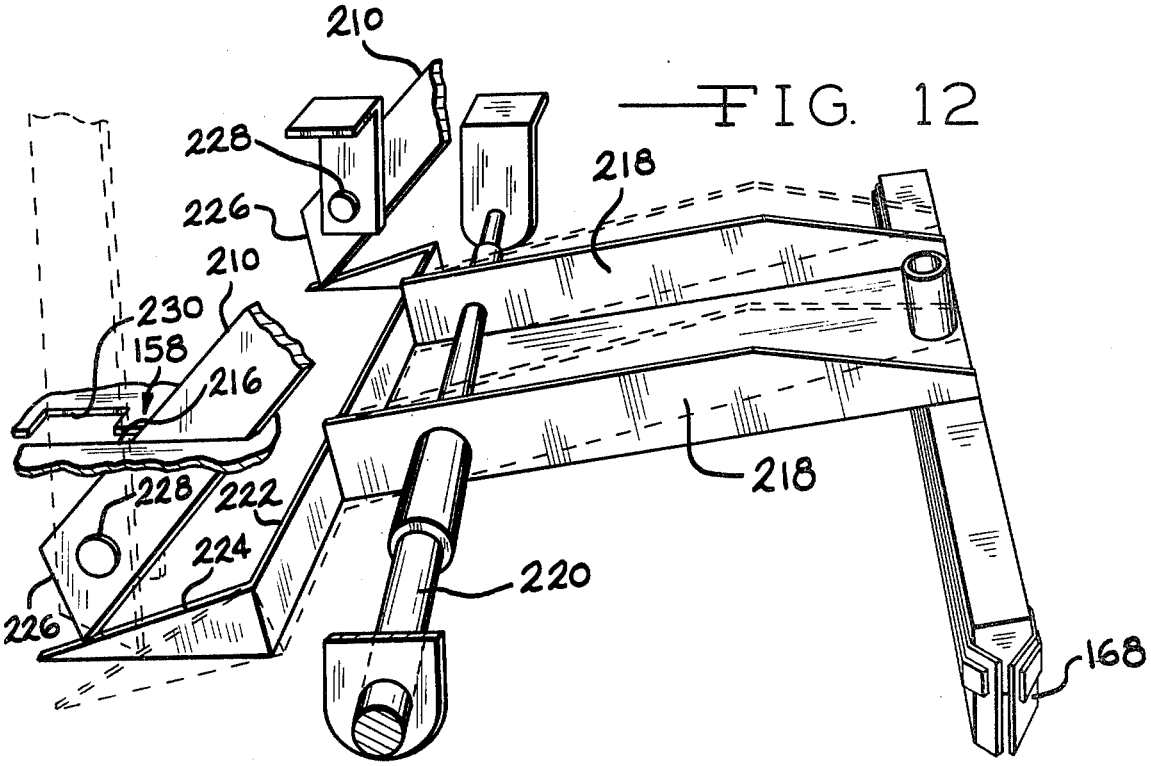
FIG. 12 is a somewhat schematic view in perspective of a portion of the machine of FIG. 9, with means for raising and lowering a rear squeegee.

The handle also provides a unique arrangement for raising the squeegee 168. As shown in FIG. 12, the squeegee is mounted on two arms 218 which are pivotally supported on an axle 220 extending across the machine. The ends of the arms 218 on the side of the axle 220 opposite the squeegee 168 have a U-shaped cam member 222 affixed thereto, having cam edges 224 at the ends. The handle 210 is designed with diagonally-shaped lower ends 226 located below pivot pins 228. When the handle is in any position other than the two extreme pivotal positions, the ends 226 engage the cam edges 224 of the U-shaped cam member 222 to pivot the arms 218 and raise the squeegee 168. Hence, it is a relatively simple matter to pivot the handle slightly from the extreme ends when transporting the machine, thereby to automatically raise the squeegee.

As shown in FIG. 12, an intermediate portion of each of the slots 216 has a notch 230 therein. When the handle 210 is vertical, the legs can be moved into the slots 230 to free the lower ends from the pivot pins 228 and thereby enable the handle to be separated from the machine for storage purposes or the like.

Various modifications of the above-described embodiments of the invention will be apparent to those skilled in the art, and it is to be understood that such modifications can be made without departing from the scope of the invention, if they are within the spirit and the tenor of the accompanying claims.

We claim:

1. A surface cleaning machine comprising a frame, a recovery container supported on said frame for receiving cleaning solution from a surface being cleaned, means for establishing a vacuum in said recovery container, a supply container supported on said frame for containing cleaning solution, means for supplying cleaning solution from said supply container to the surface, a rotatable brush rotatably supported from said frame, means supported from said frame for rotating said brush, a rear squeegee and a nozzle carried by said frame for movement toward and away from the surface, wheel means supporting part of said frame on the surface, a forward nozzle carried by said frame in front of said brush, and passage means for alternately connecting said rear nozzle and said forward nozzle with said recovery container, said recovery container being located in said supply container, a lid carried by said machine, said means for establishing a vacuum comprising a vacuum blower carried by said lid and having an inlet positioned to extend into said recovery container when said lid is closed over said containers.

2. A surface cleaning machine according to claim 1 characterized by said passage means comprising a conduit carried by said lid and movable therewith, a nipple carried by a portion of said frame, said conduit communicating with said nipple and with said recovery container when said lid is in a closed position, and a flexible exhaust hose for each of said nozzles, said nipple being connectable with either of said flexible hoses.

3. A surface cleaning machine according to claim 1 characterized further by said supply container being removable from said frame means.

4. A surface cleaning machine comprising a frame, a recovery container supported on said frame for receiving cleaning solution from a surface being cleaned, means for establishing a vacuum in said recovery container, a supply container supported on said frame for containing cleaning solution, means for supplying cleaning solution from said supply container to the surface, a rotatable brush rotatably supported from said frame, means supported from said frame for rotating said brush, a rear squeegee and a nozzle carried by said frame for movement toward and away from the surface, wheel means supporting part of said frame on the surface, a forward nozzle carried by said frame in front of said brush, passage means for alternately connecting said rear nozzle and said forward nozzle with said recovery container, a platform resiliently supported by said frame, said rotating means being a motor mounted on said platform, and said rotatable brush being drivably connected to said motor.

5. A surface cleaning machine comprising a frame, a recovery container supported on said frame for receiving cleaning solution from a surface being cleaned, means for establishing a vacuum in said recovery container, a rotatable brush rotatably supported from said frame, a supply container supported on said frame for containing cleaning solution, means supported from said frame for rotating said brush, means for supplying cleaning solution from said supply container to said brush, said supply means comprising a valve mounted in the bottom of said supply container, said valve having an operating stem extending downwardly therefrom, an elongate member pivotally carried by said frame and having a portion engageable with said stem, said elongate member forming a trough extending from a position below said valve to a position over said rotatable brush, a pivoted handle mounted on said frame, and means carried by said handle for operating said elongate member to engage said stem and open said valve, a rear squeegee and nozzle carried by said frame for movement toward and away from surface, wheel means supporting part of said frame on the surface, a forward nozzle carried by said frame in front of said brush, and passage means for alternately connecting said rear nozzle and said forward nozzle with said recovery container.

6. A surface cleaning machine comprising a frame, a supply container supported on said frame for supplying cleaning solution to a surface being cleaned, said supply container having a filler opening and a larger opening in the top thereof, a recovery container for receiving cleaning solution from the surface, said recovery container being located within said supply container and supported thereby through a flange on said recovery container in contact with said supply container around said larger opening, a rotatable brush rotatably supported from said frame, means for supplying cleaning solution from said container to said brush, a lid pivotally carried by said frame, said lid having a vacuum blower mounted thereon with an inlet communicating with said recovery container when said lid is in a closed position over said containers, a vacuum nozzle carried by said frame, and passage means connecting said nozzle with said recovery container.

7. A surface cleaning machine according to claim 6 characterized by said passage means comprising a nipple carried by said frame, and a conduit mounted on said lid and movable therewith, said conduit having one end communicating with said nipple and the other end communicating with said recovery container when said lid is closed.

8. A surface cleaning machine according to claim 6 characterized by said supply container being separate from said frame, said supply means comprising a valve having a depending operating stem mounted in the bottom of said supply container, and means pivotally mounted below said frame and engagable with said valve stem for opening and closing same for supplying cleaning solution to the brush.

9. A surface cleaning machine according to claim 6 characterized by a platform resiliently carried by said frame for limited movement toward and away from said surface, a motor mounted on said platform, said rotatable brush being drivably connected to said motor and movable with said platform independently of said frame.

10. A surface cleaning machine comprising a frame, a recovery container supported on said frame for receiving cleaning solution from surface being cleaned, a supply container supported on said frame for containing cleaning solution, means for supplying cleaning solution from said supply container to the surface, a rear squeegee and exhaust nozzle assembly carried by said frame, wheel means supporting part of said frame on the surface, a handle pivotally carried by said frame for movement between two extreme positions, in one of which a portion of the handle extends rearwardly of the machine beyond the rear end thereof and in another of which the handle extends forwardly of the machine with a portion of the handle beyond a front end of the machine, whereby the machine can be manipulated by an operator standing beyond either end thereof, said squeegee and nozzle assembly having arms pivotally carried by said frame means, cam means carried by said arms on the side of the pivot axis opposite the squeegee and nozzle and said handle having means engagable with said cam means when said handle is at positions between the extreme positions for pivoting said arms and raising said squeegee and nozzle from the surface.

11. A surface cleaning machine comprising a frame, a recovery container supported on said frame for receiving cleaning solution from surface being cleaned, a supply container supported on said frame for containing cleaning solution, means for supplying cleaning solution from said supply container to the surface, a rear squeegee and exhaust nozzle assembly carried by said frame, wheel means supporting part of said frame on the surface, a handle pivotally carried by said frame for movement between two extreme positions, in one of which a portion of the handle extends rearwardly of the machine beyond the rear end thereof and in another of which the handle extends forwardly of the machine with a portion of the handle beyond a front end of the machine, whereby the machine can be manipulated by an operator standing beyond either end thereof, said supply container being separate from said frame means and removable therefrom, said recovery container being supported substantially wholly within said supply container, a lid pivotally carried by said frame means and having a position covering said containers, and latch means connecting said lid to said supply container to hold said recovery container therein.

12. A surface cleaning machine comprising a frame, a recovery container supported on said frame for receiving cleaning solution from surface being cleaned, a supply container supported on said frame for containing cleaning solution, means for supplying cleaning solution from said supply container to the surface, a rear squeegee and exhaust nozzle assembly carried by said frame, wheel means supporting part of said frame on the surface, a handle pivotally carried by said frame for movement between two extreme positions, in one of which a portion of the handle extends rearwardly of the machine beyond the rear end thereof and in another of which the handle extends forwardly of the machine with a portion of the handle beyond a front end of the machine, whereby the machine can be manipulated by an operator standing beyond either end thereof, said frame having elongate slots through which said handle extends, with the extremeties of said slots determining the extreme positions of said handle, said elongate slots having notches at intermediate portions thereof, said handle being movable into said notches when the handle is in a generally vertical position to disengage the lower portions of said handle from the handle pivot means.

* * * * *